US006814250B1

(12) United States Patent
Madsen

(10) Patent No.: US 6,814,250 B1
(45) Date of Patent: Nov. 9, 2004

(54) FOOD SERVING SYSTEM

(76) Inventor: Jon W. Madsen, 2812 N. 600 East, Lehi, UT (US) 84043

( * ) Notice: Subject to any disclaimer, the term of this patent is extended or adjusted under 35 U.S.C. 154(b) by 0 days.

(21) Appl. No.: 10/436,489

(22) Filed: May 12, 2003

(51) Int. Cl.[7] ..... B65D 51/32
(52) U.S. Cl. ..... 220/212; 220/921; 206/501
(58) Field of Search ..... 220/212, 521–525, 220/705–710, 308, 4.26, 4.27, 912, 711, 709; 206/501, 502, 557, 821; 215/388, 389; D7/549

(56) References Cited

U.S. PATENT DOCUMENTS

| | | | | | |
|---|---|---|---|---|---|
| 1,665,289 | A | * | 4/1928 | Weaver | 229/400 |
| 2,545,733 | A | * | 3/1951 | Hatfield | 220/574.2 |
| 2,928,567 | A | * | 3/1960 | Morton | 220/574.2 |
| 3,064,800 | A | * | 11/1962 | Hart | 206/528 |
| 3,288,344 | A | * | 11/1966 | Woollen et al. | 229/103.1 |
| 3,623,634 | A | * | 11/1971 | Ikeda | 225/65 |
| D250,163 | S | * | 11/1978 | Pinson | D7/549 |
| 5,060,820 | A | | 10/1991 | Boerner | |
| 5,069,166 | A | | 12/1991 | Ahuna | |
| D327,848 | S | * | 7/1992 | Hanover | D9/436 |
| 5,180,079 | A | * | 1/1993 | Jeng | 220/705 |
| D339,030 | S | | 9/1993 | Bitel, Sr. | |
| 5,253,609 | A | | 10/1993 | Partelow et al. | |
| 5,573,131 | A | * | 11/1996 | Berjis | 220/4.03 |
| 5,577,461 | A | | 11/1996 | Sebastian et al. | |
| 5,803,305 | A | | 9/1998 | Perlis et al. | |
| 6,427,864 | B1 | * | 8/2002 | Asselin | 220/709 |
| D484,361 | S | * | 12/2003 | Jeung | D7/396.2 |
| 2003/0178433 | A1 | * | 9/2003 | Adams | |
| 2004/0007573 | A1 | * | 1/2004 | Kang | |

* cited by examiner

*Primary Examiner*—Lien Ngo

(57) ABSTRACT

A food serving system for simultaneously holding a food article and a beverage. The food serving system includes a tray assembly including a container that has an interior for carrying a beverage and a plate for carrying a food article. The plate is releasably coupled to the container. The plate includes a bottom wall that has a hole extending through the plate. In one embodiment of the present invention, the bottom wall of the plate is removably inserted in the interior of the container for preventing the beverage in the interior of the container from escaping. The hole in the plate is in communication with the interior of the container. An end of a conduit is removably inserted in the hole in the plate for transporting the beverage in the interior of the container through the hole in the plate.

12 Claims, 3 Drawing Sheets

FOOD SERVING SYSTEM

BACKGROUND OF THE INVENTION

1. Field of the Invention

The present invention relates to plates and more particularly pertains to a new food serving system for simultaneously holding a food article and a beverage.

2. Description of the Prior Art

The use of plates is known in the prior art. More specifically, plates heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,803,305; 5,060,820; 5,557,461; 5,253,609; 5,069,166; and Des. 339,030.

While these devices fulfill their respective, particular objectives and requirements, the aforementioned patents do not disclose a new food serving system. The inventive device includes a tray assembly including a container that has an interior for carrying a beverage and a plate for carrying a food article. The plate is releasably coupled to the container. The plate includes a bottom wall that has a hole extending through the plate. In one embodiment of the present invention, the bottom wall of the plate is removably inserted in the interior of the container for preventing the beverage in the interior of the container from escaping. The hole in the plate is in communication with the interior of the container. An end of a conduit is removably inserted in the hole in the plate for transporting the beverage in the interior of the container through the hole in the plate.

In these respects, the food serving system according to the present invention substantially departs from the conventional concepts and designs of the prior art, and in so doing provides an apparatus primarily developed for the purpose of simultaneously holding a food article and a beverage.

SUMMARY OF THE INVENTION

In view of the foregoing disadvantages inherent in the known types of plates now present in the prior art, the present invention provides a new food serving system construction wherein the same can be utilized for simultaneously holding a food article and a beverage.

The general purpose of the present invention, which will be described subsequently in greater detail, is to provide a new food serving system apparatus and method which has many of the advantages of the plates mentioned heretofore and many novel features that result in a new food serving system which is not anticipated, rendered obvious, suggested, or even implied by any of the prior art plates, either alone or in any combination thereof.

To attain this, the present invention generally comprises a tray assembly including a container that has an interior for carrying a beverage and a plate for carrying a food article. The plate is releasably coupled to the container. The plate includes a bottom wall that has a hole extending through the plate. In one embodiment of the present invention, the bottom wall of the plate is removably inserted in the interior of the container for preventing the beverage in the interior of the container from escaping. The hole in the plate is in communication with the interior of the container. An end of a conduit is removably inserted in the hole in the plate for transporting the beverage in the interior of the container through the hole in the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new food serving system apparatus and method which has many of the advantages of the plates mentioned heretofore and many novel features that result in a new food serving system which is not anticipated, rendered obvious, suggested, or even implied by any of the prior art plates, either alone or in any combination thereof.

It is another object of the present invention to provide a new food serving system which may be easily and efficiently manufactured and marketed.

It is a further object of the present invention to provide a new food serving system which is of a durable and reliable construction.

An even further object of the present invention is to provide a new food serving system which is susceptible of a low cost of manufacture with regard to both materials and labor, and which accordingly is then susceptible of low prices of sale to the consuming public, thereby making such food serving system economically available to the buying public.

Still yet another object of the present invention is to provide a new food serving system which provides in the apparatuses and methods of the prior art some of the advantages thereof, while simultaneously overcoming some of the disadvantages normally associated therewith.

Still another object of the present invention is to provide a new food serving system for simultaneously holding a food article and a beverage.

Yet another object of the present invention is to provide a new food serving system which includes a tray assembly including a container that has an interior for carrying a beverage and a plate for carrying a food article. The plate is releasably coupled to the container. The plate includes a bottom wall that has a hole extending through the plate. In one embodiment of the present invention, the bottom wall of the plate is removably inserted in the interior of the container for preventing the beverage in the interior of the container from escaping. The hole in the plate is in communication with the interior of the container. An end of a conduit is removably inserted in the hole in the plate for transporting the beverage in the interior of the container through the hole in the plate.

Still yet another object of the present invention is to provide a new food serving system that combines a plate with a container allowing the user to eat with both hands. The present invention makes eating outdoors more enjoyable by allowing a user move around and mingle without having to worry about juggling a plate and a beverage container. The present invention eliminates the worries of spilling a drink by placing it on an uneven surface while you try to balance your plate on your lap.

Even still another object of the present invention is to provide a new food serving system that reduces injuries caused by an insect such as, for example, bee entering a beverage container that a user is drinking. The present invention utilizes a conduit too small for a bee to enter the container holding the beverage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
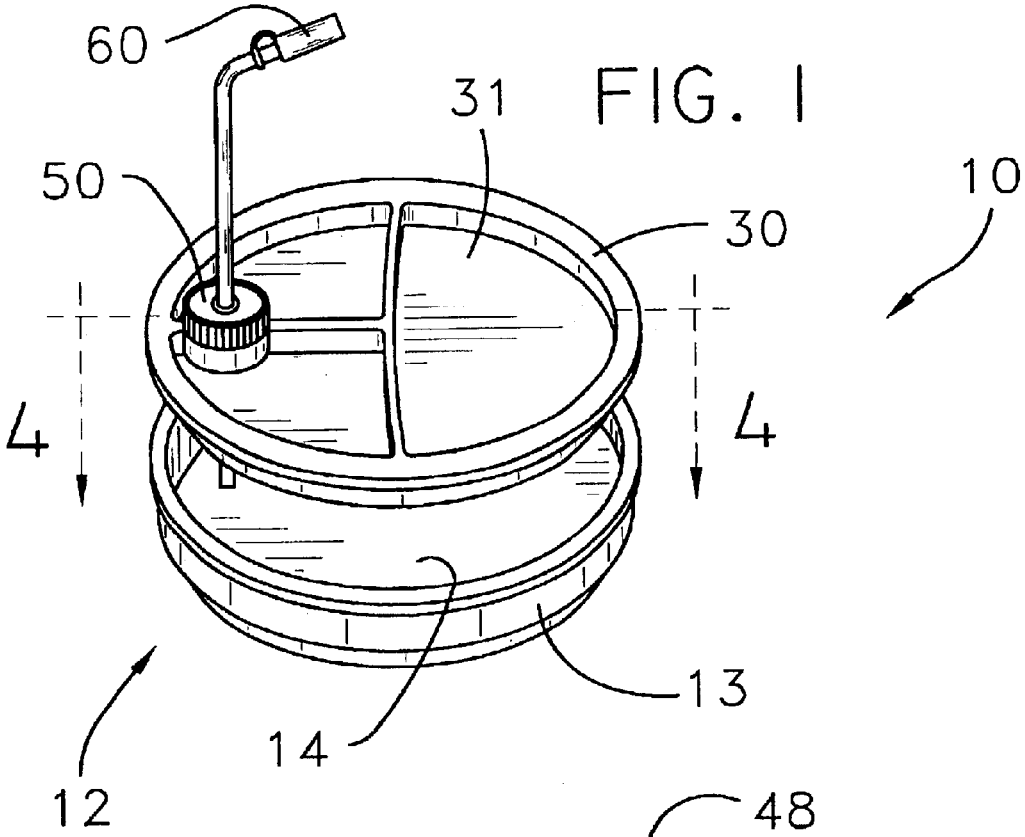
FIG. 1 is a schematic perspective view of a new food serving system according to the present invention showing a plate and a container.
Figure 2:
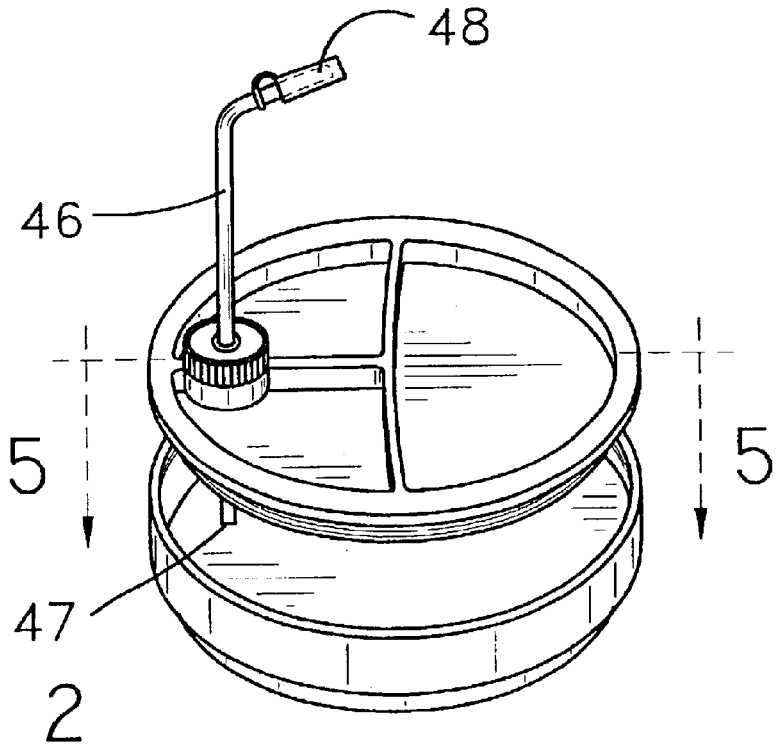
FIG. 2 is a schematic perspective view of an alternate embodiment of the present invention.

With reference now to the drawings, and in particular to FIGS. 1 through 6 thereof, a new food serving system embodying the principles and concepts of the present invention and generally designated by the reference numeral 10 will be described.

As best illustrated in FIGS. 1 through 6, the food serving system 10 generally comprises a tray assembly 12 that includes a container 13 that has an interior 14 for carrying a beverage such as, for example, water, soda, or milk. The container 13 includes a base wall 15 and a perimeter wall 16 extending from the base wall 15. An edge 18 of the perimeter wall 16 defines an opening 19 extending into the interior 14 of the container 13.

An annular lip 20 may be formed on the edge 18 of the perimeter wall 16 that can be used for more easily carrying the tray assembly 12. A thickness of the base wall 15 may taper from one side of the container 13 toward an opposite side of the container 13 to form a deeper portion of the interior 14 of the container. The tapering of the base wall 15 displaces the beverage from a shallower portion of the interior 14 of the container 13 to the deeper portion of the interior 14 of the container 13.

In one embodiment of the present invention, the perimeter wall 16 of the container 13 may include an annular groove 22 formed therein. The annular groove 22 is preferably positioned generally adjacent to the base wall 15 of the container 13. The base wall 15 of the container 13 may be removably inserted in the opening 19 extending into another of the containers 13 for stacking the containers while they are being stored. In one embodiment of the present invention, the annular groove 22 selectively abuts the edge 18 of another container's perimeter wall 16.

Figure 4:
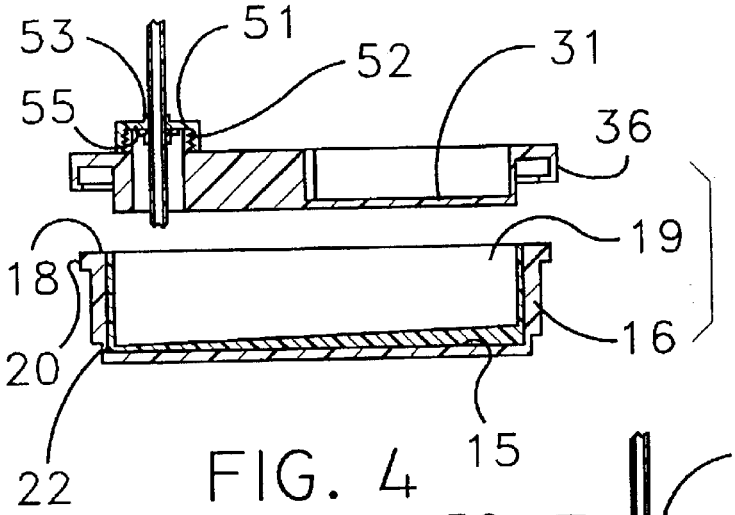
FIG. 4 is a schematic cross-sectional view of the present invention taken along line 4—4 of FIG. 1.

A plate 30 is provided for carrying a food article, such as, for example, meats, salads or sandwiches. The plate 30 is releasably coupled to the container 13. The plate 30 includes a bottom wall 31 and a peripheral wall 32 extending from the bottom wall 31. An edge 33 of the peripheral wall 32 defines an opening 34 extending into the plate 30. The edge 33 of the peripheral wall 32 may include an annular flange 35 extending from the peripheral wall 32. In one embodiment of the present invention, as illustrated in FIG. 4, the annular flange 35 may have a hook portion 36 formed thereon.

In one embodiment of the present invention, an upper surface 37 of the bottom wall 31 may include an annular collar 38 formed thereon. An end 39 of the annular collar 38 may include a hole 40 extending through the bottom wall 31of the plate 30. The plate 30 may have a hole extending through it without employing an annular collar. In one embodiment of the present invention, the plate 30 may have a plurality of intermediate walls 68. Each of the intermediate walls 68 extends from the bottom wall 31 of the plate 30. The plurality of intermediate walls 68 defines a plurality of sub-compartments 69 of the plate 30.

In one embodiment of the present invention, the bottom wall 31 of the plate 30 is removably inserted in the opening 19 in the container 13. The hook portion 36 of the annular flange 35 of the plate 30 may selectively engage the annular lip 20 of the container 13 for preventing the beverage in the interior 14 of the container 13 from escaping. The hole 40 in the annular collar 38 is in communication with the interior 14 of the container 13.

Figure 5:
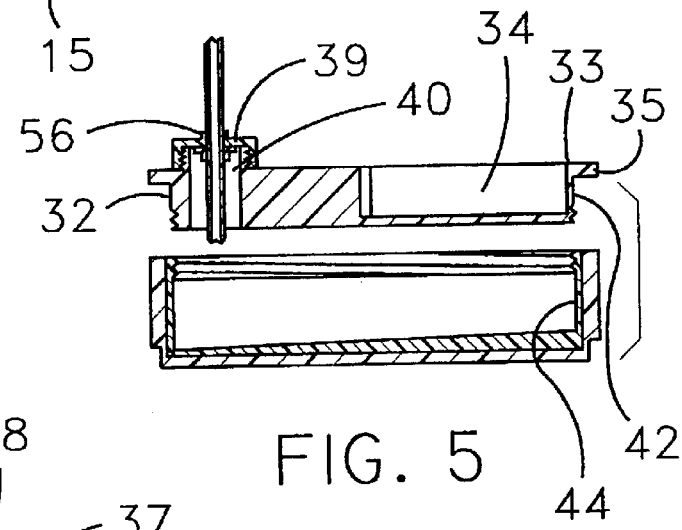
FIG. 5 is a schematic cross-sectional view of the alternate embodiment of the present invention taken along line 5—5 of FIG. 5.
Figure 3:
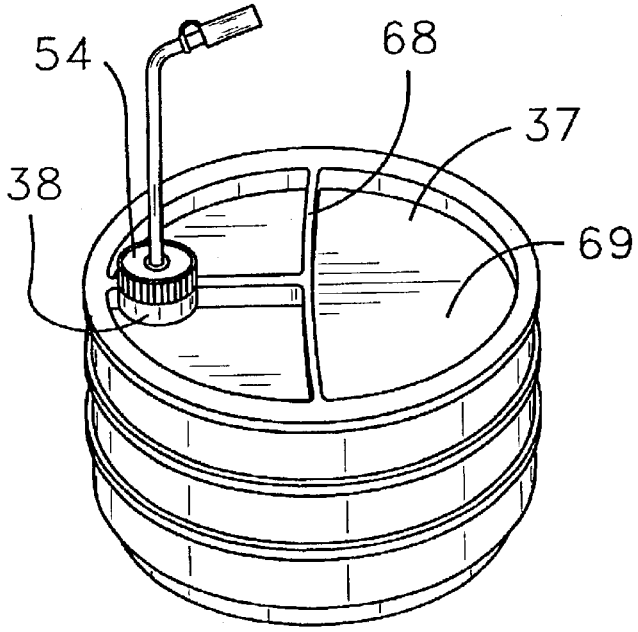
FIG. 3 is a schematic perspective view of the present invention showing a plate mounted on a stake of containers.

In one embodiment of the present invention, as particularly illustrated in FIG. 5, an outer surface 42 of the peripheral wall 32 of the plate 30 is threadedly coupled to an inner surface 44 of the perimeter wall 16 of the container 13 for preventing the beverage in the interior 14 of the container 13 from escaping.

A conduit 46 is provided for transporting the beverage in the deeper portion of the interior 14 of the container 13 through the hole 40 in the plate 30. The conduit 46 includes a first end 47 and a second end 48. The first end 47 of the conduit 46 is removably inserted in the hole 40 in the annular collar 38. The second end 48 of the conduit 46 preferably extends above the upper surface 37 of the plate 30. The conduit 46 may comprise a straw.

A cover 50 may be provided for selectively covering the hole 40 in the annular collar 38, the cover 50 may include a wall 51 and a peripheral wall 52 extending from the wall 51 of the cover 50. The peripheral wall 52 of the cover 50 may be threadedly coupled to the annular collar 38. The wall 51 of the cover 50 preferably includes a hole 53 extending therethrough where the conduit 46 may be extended into the interior 14 of the container 13. An upper surface 54 and a lower surface 55 of the wall 51 may include a pair of axially aligned annular ridges 56 formed around the hole 53 in the cover 50 to prevent the liquid in the container 13 from escaping through the hole 53 in the cover 50.

A cap 60 may be provided for selectively covering the second end 48 of the conduit 46. The cap 60 is removably coupled to a portion of the conduit 46 for preventing the beverage in the interior 14 of the container 13 from escaping through the conduit 46.

Figure 6:
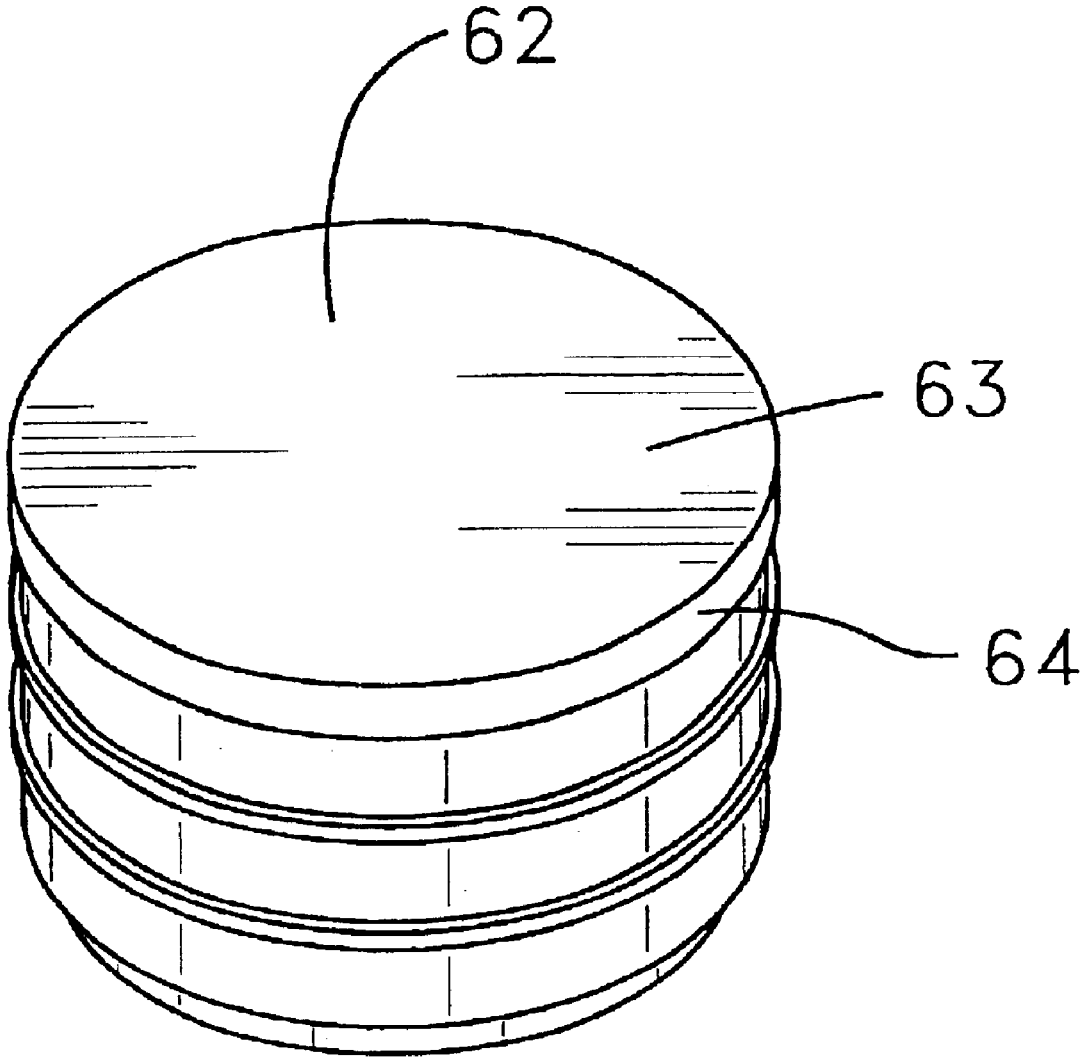
FIG. 6 is a schematic perspective view of the present invention showing a lid mounted on the plate and containers.

As illustrated in FIG. 6, a lid 62 may be provided for selectively covering the opening 34 in the plate 30. The lid 62 may include a wall 63 and a perimeter wall 64 extending from the wall 63 of the lid 62. The perimeter wall 64 of the lid 62 may selectively abut the annular flange 35 of the plate 30 when the lid 62 covers the opening 34 in the plate 30.

In use, the beverage is placed in the interior 14 of the container 13. The plate 30 is then coupled to the container 13. The food article or articles may then be placed on the plate 30. The conduit 46 is inserted in the hole 40 extending through the annular collar 38 for siphoning the beverage from the interior 14 of the container 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A food serving system capable of simultaneously holding a food article and a beverage, said system comprising:

a tray assembly including:

a container having an interior for carrying a beverage;

a plate for carrying a food article, said plate being releasably coupled to said container, said plate having a bottom wall, said plate having a hole extending through said-plate;

wherein said bottom wall of said plate is removably inserted in said interior of said container for preventing the beverage in said interior of said container from escaping said hole in said plate being in communication with said interior of said container;

a conduit for transporting the beverage in said interior of said container through said hole in said plate, an end of said conduit being removably inserted in said-hole in said plate; and said plate comprising an annular collar, said hole of said plate extending through said annular collar, an end of said annular collar extending above an upper surface of said plate for inhibiting food articles on said plate from entering said hole and falling into said container, wherein said conduit is removably inserted in said hole extending through said collar;

wherein said container has a base wall and a perimeter wall extending from said base wall, an edge of said perimeter wall defining an opening extending into said interior of said container; and wherein a thickness of said base wall tapers from one side of said container toward an opposite side of said container to form a deeper portion of said interior of said container for displacing the beverage from a shallower portion of said interior of said container to said deeper portion of said interior of said container, said end of said conduit being positioned generally in said deeper portion of said interior of said container.

2. The food serving system of claim 1, wherein said perimeter wall of said container has an annular groove formed therein, said base wall of said container being removably inserted in said opening in another of a plurality of containers, wherein the annular groove of each of said containers selectively abuts said edge of said perimeter wall.

3. The food serving system of claim 1, wherein said plate has a peripheral wall extending from said bottom wall, of said plate an edge of said peripheral wall of said plate defining an opening extending into said plate.

4. The food serving system of claim 3, wherein said edge of said peripheral wall of said plate has an annular flange extending from said peripheral wall of said plate, wherein said annular flange has a hook portion formed thereon, said hook portion being releasably coupled to an annular lip formed on said edge of said perimeter wall of said container.

5. The food serving system of claim 4, wherein said bottom wall of said plate is removably inserted in said opening in said container, said hook portion of said annular flange of said plate selectively engaging said annular lip about said opening of said container for preventing the beverage in said interior of said container from escaping.

6. A The food serving system of claim 3, wherein an outer surface of said peripheral wall of said plate is threadedly coupled to an inner surface of a perimeter wall of said container for preventing the beverage in said interior of said container from escaping.

7. The food serving system of claim 1, additionally including a cover for selectively covering said hole in said annular collar, said cover being threadedly couplable to said annular collar.

8. The food serving system of claim 7, wherein a wall of said cover has a hole extending therethrough, an upper surface and a lower surface of said wall of having cover having a pair of axially aligned annular ridges formed around said hole in said cover, said conduit being removably inserted through said hole in said cover, wherein each of said annular ridges prevent the liquid in said container from escaping through said hole in said cover.

9. The food serving system of claim 1, additionally including a cap for selectively covering an end of said conduit, said cap being removably coupled to a portion of said conduit.

10. The food serving system of claim 3, additionally including a lid for selectively covering said opening in said plate, said lid having a wall and a perimeter wall extending from said wall of said lid, said perimeter wall of said lid selectively abutting an annular flange about said edge of said plate when said lid covers said opening in said plate.

11. The food serving system of claim 1, additionally including a plurality of intermediate walls, each of said intermediate walls extending from said bottom wall of said plate, said plurality of intermediate walls defining a plurality of sub-compartments of said plate.

12. A food serving system capable of simultaneously holding a food article and a beverage, said system comprising:

a tray assembly including:

a container having an interior for carrying the beverage, said container having a base wall and a perimeter wall extending from said base wall, an edge of said perimeter wall defining an opening extending into an interior of said container, an annular lip being formed on said edge of said perimeter wall, a thickness of said base wall tapering from one side of said container toward an opposite side of said container to form a deeper portion of said interior of said container for displacing a beverage from a shallower portion of said interior of said container to said deeper portion of said interior of said container;

wherein said perimeter wall of said container having an annular groove formed therein, said annular groove being positioned generally adjacent to said base wall of said container, said base wall of said container being removably inserted in said opening in another of a plurality of containers, wherein the annular groove of each of said containers selectively abuts said edge of said perimeter wall;

a plate for carrying a food article, said plate being releasably coupled to said container, said plate having a bottom wall and a peripheral wall extending from said bottom wall, an edge of said peripheral wall of said plate defining an opening extending into said plate, said edge of said peripheral wall of said plate having an annular flange extending from said peripheral wall of said plate, wherein said annular flange has a hook portion formed thereon, an upper surface of said bottom wall having au annular collar formed thereon, an end of said annular collar having a hole extending through said bottom wall of said plate;

wherein said plate has a plurality of intermediate walls, each of said intermediate walls extending from said bottom wall of said plate, said plurality of intermediate walls defining a plurality of sub-compartments of said plate;

wherein said bottom wall of said plate is removably inserted in said opening in said container, said hook portion of said annular flange of said plate selectively engaging said annular lip of said container for preventing the beverage in said interior of said container from escaping, said hole in said plate being in communication with said interior of said container;

wherein an outer surface of said peripheral wall of said plate is threadedly coupled to an inner surface of said perimeter wall of said container for preventing the beverage in said interior of said container from escaping;

a conduit for transporting the beverage in said deeper portion of said interior of said container through said bole in said plate, said conduit having a first end and a second end, said first end of said conduit being removably inserted in said hole in said annular collar, said second end of said conduit extending above said upper surface of said plate;

a cover for selectively covering said hole in said annular collar, said cover having a wall and a peripheral wall extending from said wall of said cover, said peripheral wall of said cover being threadedly coupled to said collar, said wall of said cover having a hole extending therethrough, an upper surface and a lower surface of said wall of said cover having a pair of axially aligned annular ridges formed around said hole in said cover, said conduit being removably inserted through said hole in said cover, wherein each of said annular ridges prevent the liquid in said container from escaping through said hole in said cover;

a cap for selectively covering said second end of said conduit, said cap being removably coupled to a portion of said conduit; and a lid for selectively covering said opening in said plate, said lid having a wall and a perimeter wall extending from said wall of said lid, said perimeter wall of said lid selectively abutting said annular flange of said plate when said lid covers said opening in said plate.

* * * * *